United States Patent [19]

Stratton

[11] 4,186,734

[45] Feb. 5, 1980

[54] INFLATABLE SEAT UNIT

[76] Inventor: John M. Stratton, 2936 Briar Knoll Dr., Los Angeles, Calif. 90046

[21] Appl. No.: 888,834

[22] Filed: Mar. 22, 1978

[51] Int. Cl.[2] ..... A61H 1/00

[52] U.S. Cl. ..... 128/33

[58] Field of Search ..... 128/24 R, 33, 64, 24.1, 128/24.2

[56] References Cited

U.S. PATENT DOCUMENTS

| | | | |
|---|---|---|---|
| 2,684,672 | 7/1954 | Summerville | 128/33 |
| 2,819,712 | 1/1958 | Morrison | 128/33 |
| 2,852,020 | 9/1958 | Murphy | 128/24.1 |
| 3,008,465 | 11/1961 | Gal | 128/33 |
| 3,192,540 | 7/1965 | Swank | 128/33 |
| 3,446,203 | 5/1969 | Murray | 128/24.2 |
| 3,483,862 | 12/1969 | Takeuchi | 128/33 |
| 3,613,671 | 10/1971 | Poor | 128/24 R |

FOREIGN PATENT DOCUMENTS

| | | | |
|---|---|---|---|
| 984251 | 2/1976 | Canada | 128/33 |

OTHER PUBLICATIONS

H. Koch & Sons (Gulf & Western Mfg. Co.) Koch Comfort Cushion System Installation & Maintenance Manual–Jan. 1977.

*Primary Examiner*—Lawrence W. Trapp
*Attorney, Agent, or Firm*—Robert E. Geauque

[57] ABSTRACT

An inflatable seat unit having a plurality of air cells positioned longitudinally adjacent to each other and fully contained within a cavity in a piece of foam material, the cells being covered by a portion of the foam material to form a seat surface, the portion having a thickness which permits the rise and fall of the air cells to be felt by the occupant of the seat, a back plate for supporting the cells and causing the cells to rise in the direction of the portion of foam material, and a control mechanism for admitting air into the air cells in a controlled manner and fully contained within said piece of foam material and rigidly secured thereto, said control mechanism having a rotating valve which is forced against the valve openings by pressurized air introduced to one side of the valve during rotation.

9 Claims, 25 Drawing Figures

INFLATABLE SEAT UNIT

BACKGROUND OF THE INVENTION

It has been desirable to place on the surface of seats and backrests inflatable devices which will press on the body of the occupant in order to produce a massaging effect and thereby extend the time in which the seat can be used without discomfort to the occupant. In some of these devices, inflatable air cells have been provided on the seat surface and the inflation of the cells has produced a simple pulsating or intermittent surface pressure variation without producing a transitional pressure wave movement. While such movement has some effect in relieving discomfort, it has been long known that directional massage movement is more effective to relieve discomfort.

An example of a device which provides a transitional pressure wave movement for a massaging effect on a seat is disclosed in U.S. Pat. No. 3,613,671 to John H. Poor and Charles H. Logan. This patented device utilizes a rotating valve for sequentially inflating a plurality of inflatable air cells which are contained in a plurality of pockets in a fabric seat cover. A backing for the cells rests on the bottom and back seat surfaces to position the device on the seat. Thus, this patented device is entirely separate from the seat and is simply added threto when desired.

SUMMARY OF THE INVENTION

The present invention provides an inflatable seat unit which is designed to be incorporated as an integral part of the seat structure. The unit is adopted for installation into a pocket in the surface of a large seat or is adapted to cover the entire top surface of a single seat. The unit can comprise foam material on opposite sides of the air cells so that the unit can rest on a solid support and still be comfortable. Also, the material can be on only one side and the air cells can be directly supported by coil springs.

A control mechanism is provided to control the sequential inflation of the air cells to produce a translational wave of approximate sinusoidal form along the seat surface where the cells are located. The mechanism comprises a rotating valve which can vary the rate of the wave movement by varying the rotating speed. Also, the pressurized air supply forces the rotor against the stator which contains the air passage so an effective rotary seal is obtained. The tops of all the air cells are covered by a layer portion of plastic foam of a thickness that permits the movement of the cells to be transmitted to the body of the occupant. By providing a seat surface of plastic foam, the appearance and construction of the seat is compatible with most types of seat construction and provides a comfortable seat surface when the unit is not being inflated.

Since the construction of the unit is similar in appearance to the remaining seat structure, the fact that a seat incorporates the inflatable unit is not apparent from casual observation of the seat. The complete control mechanism and tubes, as well as the air cells themselves, can be fully contained within the unit so that the only external components are the electrical line for the motor and the air pressure and exhaust lines. Therefore, the present invention provides an inflatable seat unit which can be incorporated as a modification to the seat construction and, in both cases, the unit does not detract from the seat appearance.

DESCRIPTION OF THE PREFERRED EMBODIMENT

Figure 1:
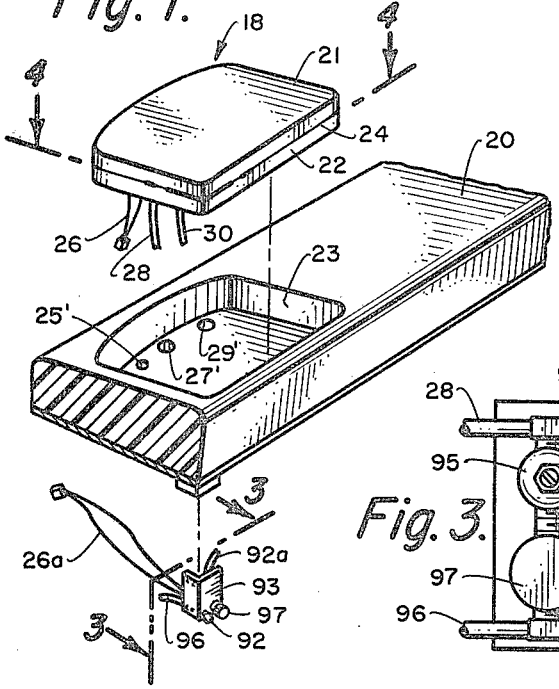
FIG. 1 is an expanded perspective view of a large seat having a cavity for receiving the inflatable seat unit.
Figure 3:
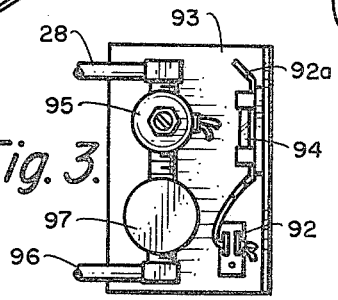
FIG. 3 is an elevational view along line 3—3 of FIG. 1 showing one side of the control panel for the seat unit.
Figure 3A:
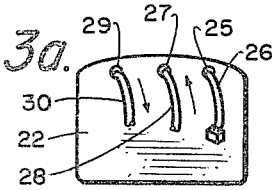
FIG. 3A is a bottom plan view of the inflatable unit.

Referring to FIG. 1, the inflatable seat unit 18 is shown in position for insertion into cavity 23 in a large foam rubber seat 20 for multiple occupants. The unit 18 comprises a top foam layer 21 and a bottom foam layer 22 which contains a cavity 23, and the layers are cemented together along the dividing line 24. The bottom layer 22 (FIG. 3A) contains opening 25 for electrical line 26, opening 27 for pressurized air line 28, and opening 29 for exhaust air line 30. Cavity 23 of seat 20 contains openings 25', 27' and 29' for the lines leaving openings 25, 27 and 29, respectively, so that the lines can reach to the exterior of the seat 22.

Figure 4:
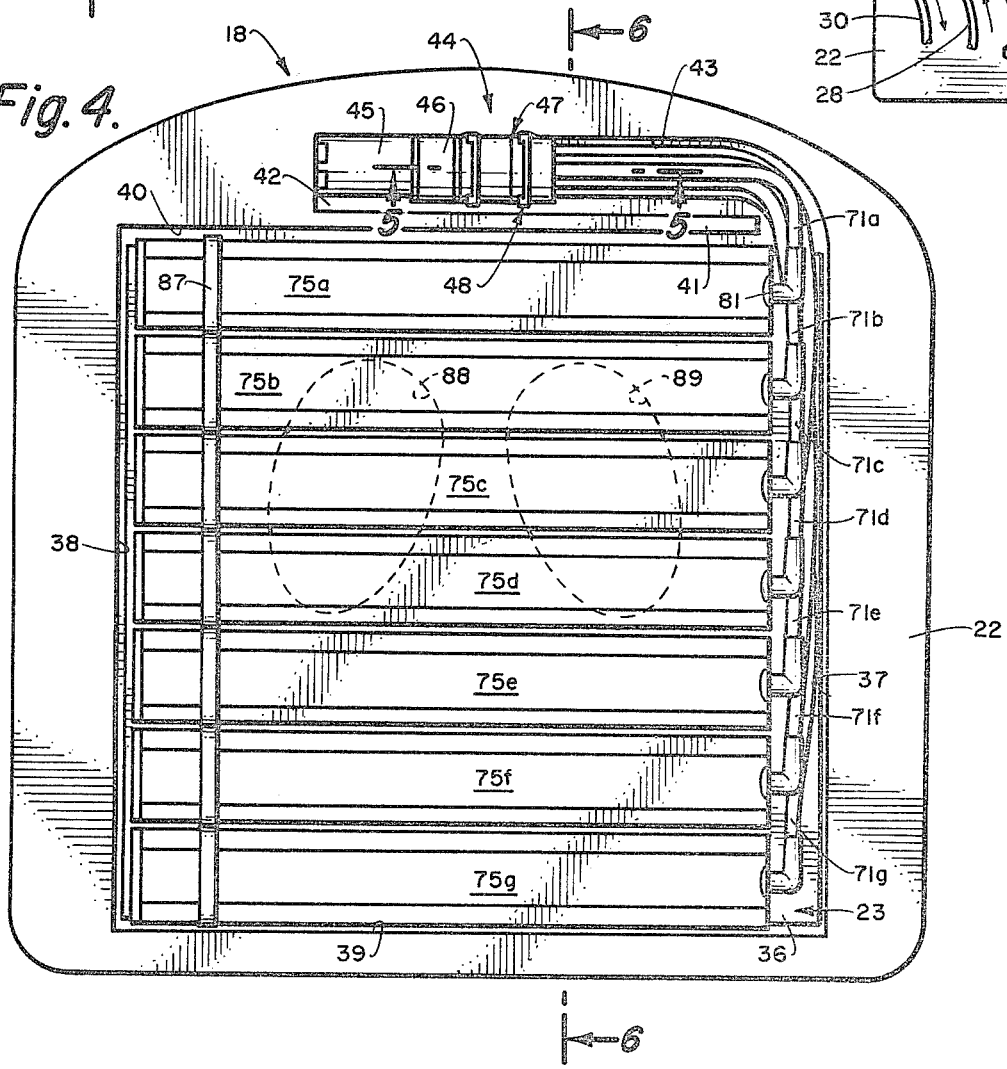
FIG. 4 is a horizontal section along line 4—4 of FIG. 1 illustrating the cavity in the seat unit containing the air cells and control mechanism.
Figure 5:
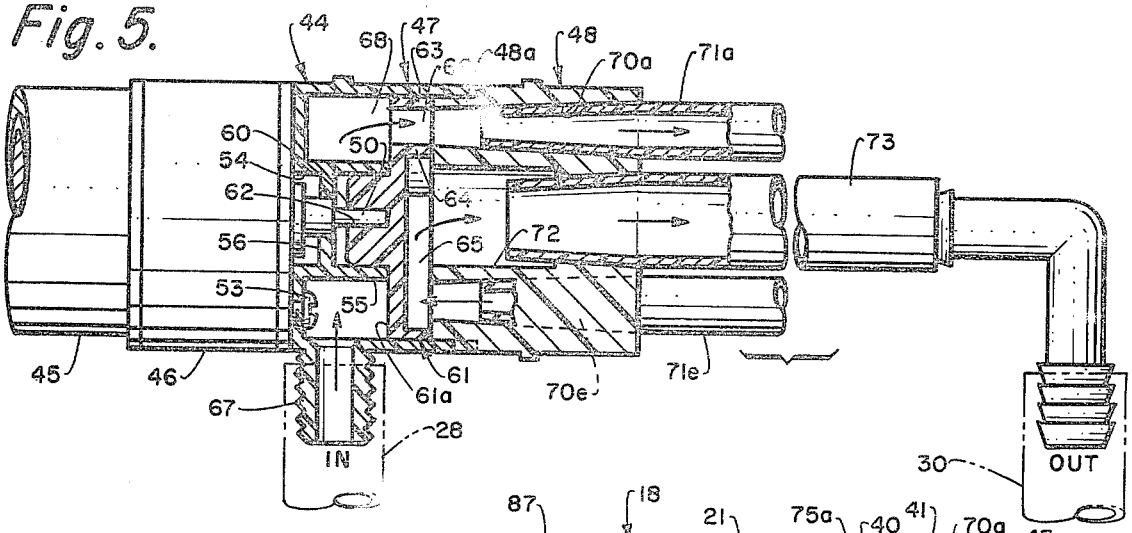
FIG. 5 is a vertical section along line 5—5 of FIG. 4 showing the control mechanism for distributing air to the inflatable cells.
Figure 6:
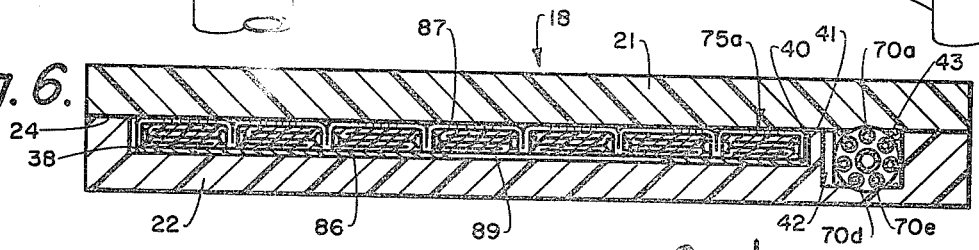
FIG. 6 is a transverse vertical section along line 6—6 of FIG. 4 illustrating the air cells in deflated condition.

Referring to FIG. 4, cavity 23 in foam layer 22 has straight side walls 37 and 38, a front wall 39, and a bottom surface 36. Back sidewall 40 is a side of a foam extension 41 which forms a cavity 42 terminating with wall 43. Cavity 42 contains control mechanism 44 comprising motor 45, gear reduction box 46, valve rotor housing 47, and stator 48. The complete control mechanism is cemented to the surfaces of cavity 42.

Motor 45 can be air driven or a twelve volt DC motor driving a gear reduction 46 of standard construction which has a flat rectangular drive end 50. Rotor housing 47 is secured to the end of the gear reduction train by means of a plurality of screws 53, and the housing has a central opening 54 for receiving output member 50. A sleeve 55 extends from the opening 54 and contains a cross-member 56 having an opening for the drive end 50. The sleeve 55 also receives an enlargement or mounting projection 60 on flat surface 61*a* of valve rotor 61 and the enlargement has a slot opening 62 which receives the drive end 50. Valve rotor 61 has a circumferential rim 63 across which extends a projecting wall 64 to form an exhaust space 65 and define a valve opening 66 through the valve. The wall 64 projects outwardly from the flat valve surface 61*a* by the same amount as rim 63. The rotor housing 47 has an extension pipe 67 which connects with high pressure air line 28 and introduces pressurized air into chamber 68 in the rotor housing which is in continual communication with valve opening 66.

Rotor housing 47 receives reduced end 48*a* of valve stator 48 and the stator has a small projection 69 (see FIG. 11) which enters into an edge groove 69*a* in housing 47 in order to properly locate stator 48 with respect to the housing 47. The stator 48 contains seven passages 70*a*–70*g* equally spaced around the circumference and extending completely through the stator. The ends of plastic air tubes 71*a*–71*g* are secured into the passages 70*a*–70*g*, respectively. Also, the housing 48 has a central passage 72 into which is secured the end of exhaust tube 73 which connects to the exterior of the unit through line 30. Exhaust air leaving the passages 70*a*–70*g* enter valve space 65 and leaves through passages 72 and 73. As illustrated, the end of rim 63 and of wall 64 engage the end of stator 48*a* so that the pressure in chamber 68 will seal the rotor 61 against the stator.

The air tubes 71*a*–71*g* pass along the side wall 37 of cavity 23 and connect with individual air cells 75*a*–75*g*. Each of the air cells 75*a*–75*g* comprise double overlapping tubes 76 and 77 (see FIG. 8) which are sealed together at end 78. The opposite end 80 of each cell has an opening receiving an angular fitting 81 which connects the interior of the overlapping tubes to one of the tubes 71*a*–71*g*. The overlapping tube 76 comprises layers 82 and 83 and overlapping tube 77 comprises layers 84 and 85. The layers 83 and 84 stop short of the fitting 81 to permit air to enter both of the overlapping tubes 76 and 77, and inflate the air cell. A thin plastic board 86 (approx. 1/16" thick) is positioned on bottom surface 36 of cavity 23 and the cells are secured to the backing board by a strap 87 which loosely passes over each cell and is secured to the board between each cell. As illustrated in FIG. 4, the tubes 71*a*–71*g* pass along the wall 37 of cavity 36 in order to connect the individual inflatable cells 75*a*–75*g* to the stator 48 of the control mechanism 44.

Figure 7:
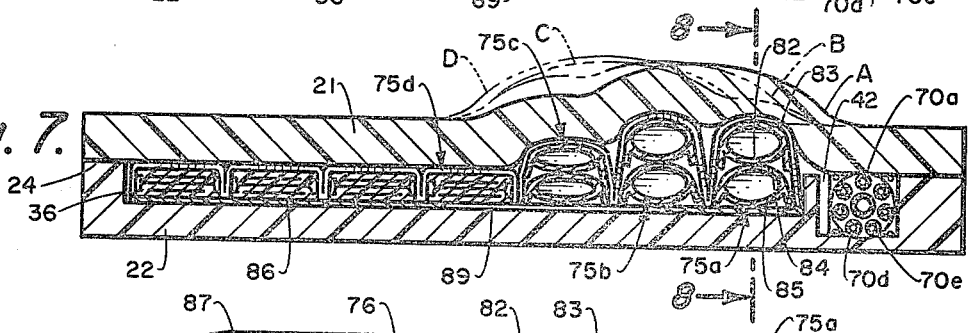
FIG. 7 is a sectional view similar to FIG. 6 showing several of the air cells inflated to raise the top foam surface portion.
Figure 8:
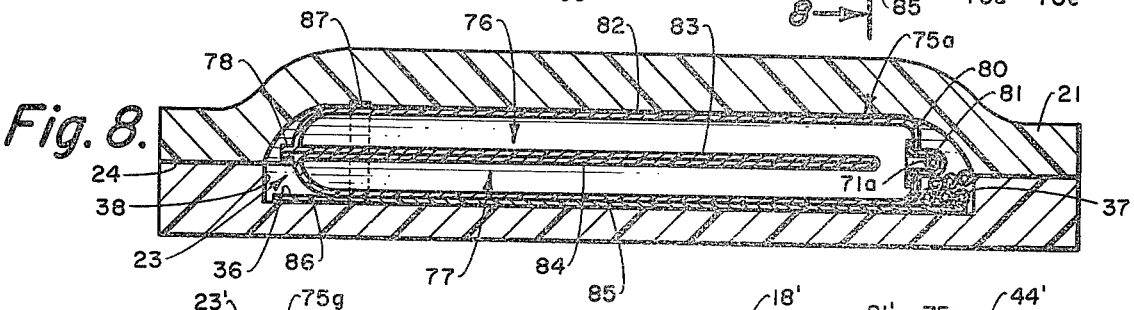
FIG. 8 is a vertical section along line 8—8 of FIG. 7 illustrating the dual tube construction of each of the air cells.
Figure 10:
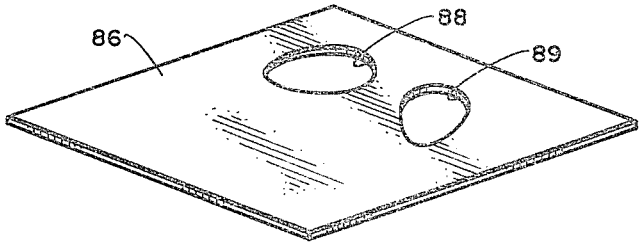
FIG. 10 is a perspective view of the base board to which the individual inflatable cells are attached, showing the openings for the ischial tuberosities of the occupant.

Both the tubes 71*a*–71*g* and air cells 75*a*–75*g* are constructed to flexible material, such as rubber or plastic. Each of the cells 75*a*–75*g* in the non-inflated condition lie flat against a backing board 86 and the loops 87 are loose enough to permit the individual cells to rise above the backing 86 when inflated, as illustrated in FIG. 8. In FIG. 7, three adjacent cells 75*a*, 75*b*, and 75*c* are shown at least partially inflated and the remainder of the cells 75*d*–75*g* are shown uninflated. As illustrated, the backing board 86 causes the cells to rise above the board without depressing the board 86 into the bottom cavity surface 36. As illustrated in FIGS. 4 and 10, the backing board 86 contains two openings 88 and 89 which are located opposite the ischial tuberosities of the seat occupant for comfort. The control mechanism 44 is cemented or otherwise secured to the side wall 43 and bottom surface 36 in order to be rigidly held in the seat unit 18. A portion of layer 21 covers all the air cells and another portion covers the control mechanism and all air tubes after layer 21 is sealed to the bottom foam layer 22. The inflatable unit 18 can be constructed of any flexible foam material and the top foam layer 21 can be of a thickness (preferably one-half to one inch) which will transmit the rise and fall of the air cells firmly to the occupant so that the occupant can be massaged by the translational wave motion created by the air cells in a manner to be described. Also, the layer 21 will be thick enough to comfortably support the seat occupant when none of the cells are inflated. As an example, the top layer can be fabricated of a foam having a density of about 2.6 lbs./cu. ft. and the lower layer fabricated of a foam which a density of about 3.9 lbs./cu. ft. The lower layer can be more dense to provide a firm base for the inflatable action. Examples of suitable foam materials are polyether and polyurethane.

Figure 11:
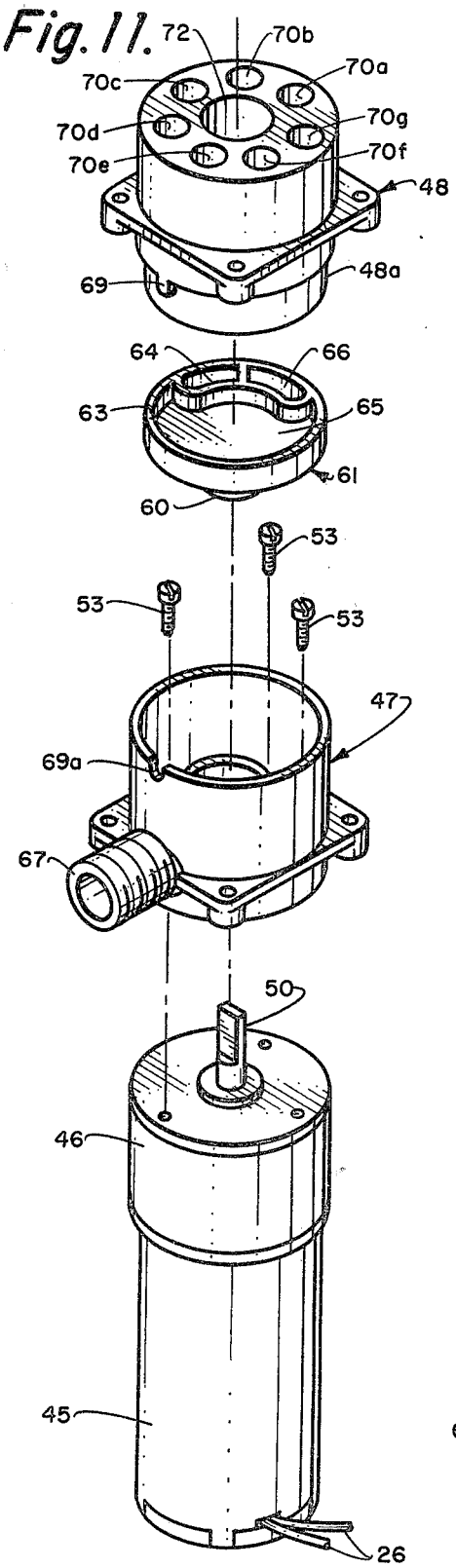
FIG. 11 is an expanded perspective of the control mechanism showing the drive motor, the valve rotor and the valve stator for distributing air pressure to the air cells.
Figure 12:
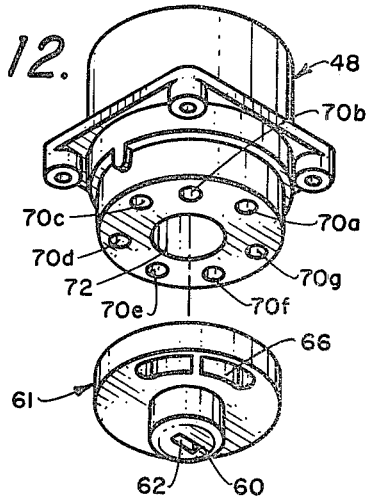
FIG. 12 is an expanded perspective showing the relationship between the valve opening in the rotor and the air passages in the stator for a seven cell unit.
Figure 13A:
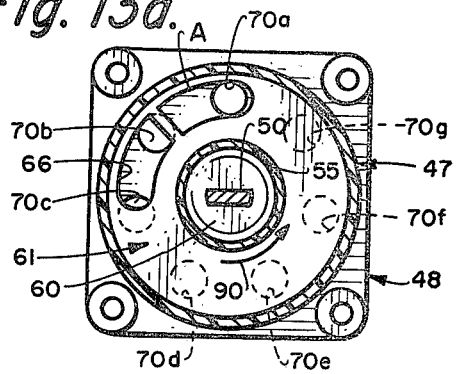
FIGS. 13*a*, 13*b* and 13*c* show progressive positions of the valve opening relative to the air passages.

It is apparent that as the valve rotor 61 is rotated by motor 45, the valve opening 66 will open successive air passages 70*a*–70*g* and will inflate the air cells sequentially. As illustrated in FIG. 7, the cells 75*a* and 75*b* are fully inflated and cell 75*c* is being inflated. This inflation causes a portion of top foam layer 21 to rise and push against the seat occupant to massage the occupant. Position A of the valve opening at this time is illustrated in FIGS. 11, 12 and 13*a*. In FIG. 13*a*, opening 66 is rotating in the direction of arrow 90 and the forward end of opening 66 is commencing to uncover opening 70*c*. The remaining openings 70*d*–70*g* are all connected to exhausts through tubes 71*d*–70*g*, exhaust space 65, exhaust space 72 and exhaust tube 73. The length of opening 66 is such as to open a maximum of 2.6 passages.

Figure 13B:
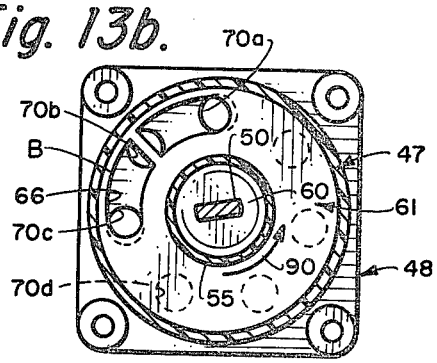
Figure 13C:
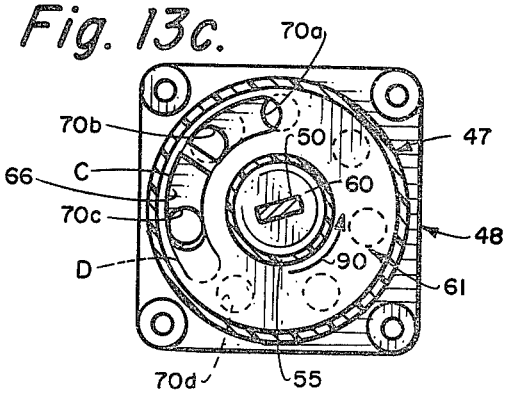

Further rotation of the valve rotor to Position B in FIG. 13*b* causes passages 70*a*, 70*b* and 70*c* to have a maximum of 2.6 passages open, passages 70*a* and 70*c* each having 0.2 of their area closed. Further rotation to position C of FIG. 13*c* starts the closing of passages 70*a* and the deflation of cell 75*a*. Further rotation to the dashed line position D of FIG. 13*c* causes passage 70*a* to close and passage 70*b* and 70*c* are fully open, with passage 70*d* the next to start opening. The various positions of the top foam layer 21 are roughly indicated in FIG. 7 without the pressure of an occupant and each position line is labeled with the corresponding valve position in FIGS. 13*a*–13*c*. It is apparent that as the valve rotor moves, an approximate sinusoidal wave form will travel across the unit 18 by inflation and deflation of the various air cells.

The control mechanism 44 is controlled by a switch 92 on panel 93 (see FIG. 3) and the switch is connected to a 12V d.c. source through lead 92*a* and fuse 94. The switch controls motor 45 through leads 26*a* and also controls solenoid valve 95 through additional leads (not shown). As source of air pressure is connected by passage 96 to a pressure regulator 97 mounted on panel 93 and the regulator is connected through solenoid valve 95 to passage 28 leading to the valve housing 47. When the switch 92 is turned on, the solenoid valve 95 opens to introduce pressurized air to the valve rotor and also the motor 45 starts to rotate the valve. As long as the switch 92 is on, the translational wave will move across the seat unit. The control panel can be located on the instrument panel of a vehicle or attached to the seat (see FIG. 2) or located in any other convenient place.

It is preferable that the reduction gearing 46 drive the valve rotor at about 17 rpm but the speed can be reduced to approximately 7 rpm without destroying the massage effect. Below 7 rpm the occupant will feel the separate pulses developed by each air cell. At 23 rpm and above, the occupant will feel a rapid sensation with less massage effect. The speed of the motor 45 can be varied by the occupant by adjusting a potentiometer (not shown) in the motor circuit. Also, by suitable connections (not shown), the direction of rotation of the motor 45 can be changed.

Figure 2:
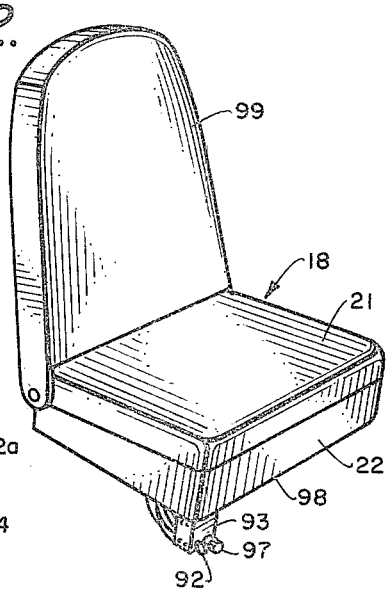
FIG. 2 is a perspective of a single occupant seat with the inflatable seat unit covering the entire bottom seat surface.
Figure 9:
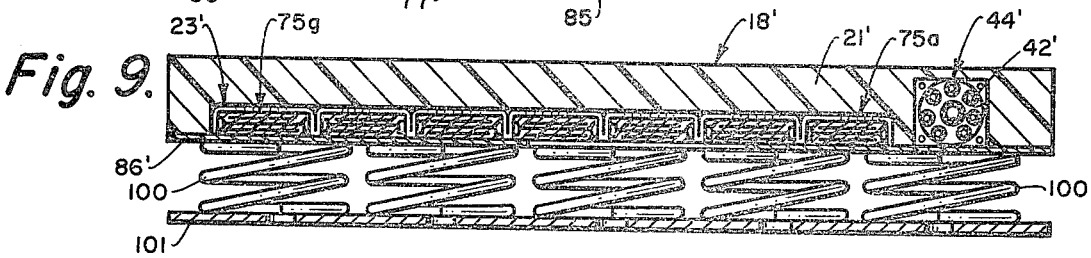
FIG. 9 is a vertical section of a modified seat unit incorporated into a seat structure utilizing coil springs.

As illustrated in FIG. 2, the seat unit 18 can be cut to the shape of a single seat 98 so that it can rest upon a support surface of the seat structure. Another modification 18' of the seat unit is illustrated in FIG. 9 wherein backing board 86' extends along the bottom of layer 21' to the outside edges thereof in order to form the cavity 23' in the layer 21'. The individual inflated air cells 75*a*–75*g* are located in the cavity 23' and are supported by the back plate 86'. Also, the control mechanism 44' is located in cavity 42' of layer 21' and the air tubes 71*a*–71*g* are also located at one side of cavity 23'. The unit 18' is constructed to be incorporated in a seat structure which utilizes metal coil springs 100 supported on a base plate 101. The backing plate 86' can rest firmly on the top of coil springs to support the seat unit over any given section of the seat.

Figure 14:
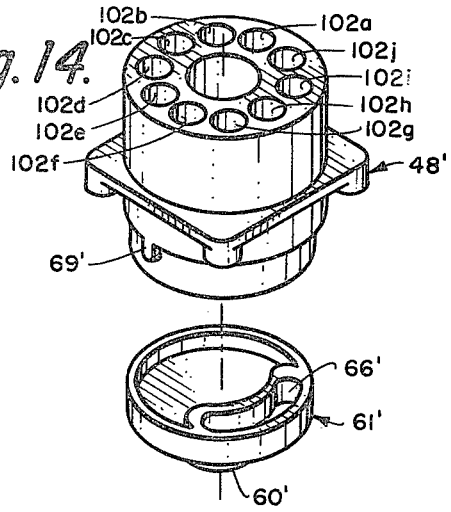
FIG. 14 is an expanded perspective of a modified valve rotor and stator for an inflatable seat unit having ten individual air cells.
Figure 15:
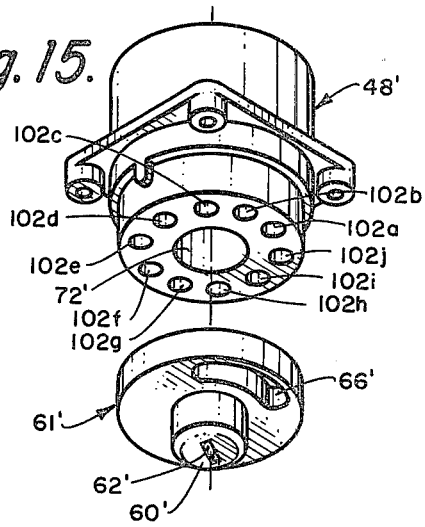
FIG. 15 is an expanded perspective of the device of FIG. 14 showing the passages in the stator for the 10 cell unit.
Figure 16A:
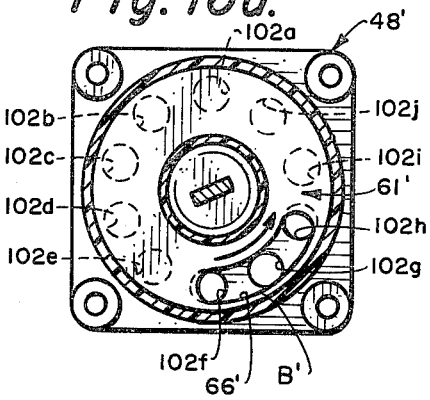
FIGS. 16*a*, 16*b* and 16*c* show progressive positions of the rotor valve opening with respect to the passages in the stator of FIG. 15.
Figure 16B:
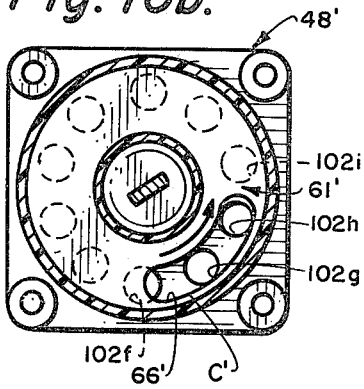
Figure 16C:
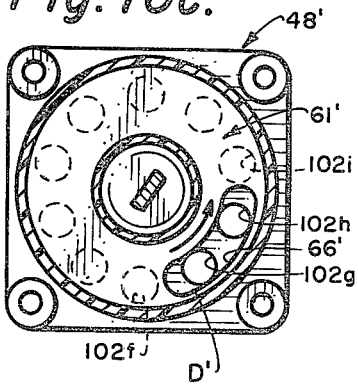

In FIGS. 14 and 15, a modified valve rotor 61' for a 10 cell seat inflating unit is shown and the unit can be constructed similar to unit 18 or unit 18', with the addition of two air cells. The stator 48' contains ten air passages 102*a*–102*j*, and the valve rotor 61' contains a valve opening 66' which is large enough to open a maximum of 2.6 passages (see FIG. 16*a*). The rotor 61' has an opening 62' for receiving the drive end 50 of the motor 45. As illustrated in FIG. 16*a*–16*c*, the valve opening 66' controls the passages 102*a*–102*j* in a similar manner as the seven passages 70*a*–70*g* are controlled by the opening 66. In position B' of FIG. 16*a*, opening 66' opens 2.6 openings 102*f*–102*h* similar to Position B of FIG. 13*b*. In the position C' of FIG. 16*b*, opening 66' is closing passage 102*f* similar to Position C of FIG. 13*c*. In position D' of FIG. 16*c*, opening 66' opens only passages 102*g* and 102*h* similar to Position D of FIG. 13*c*. Thus, the same type of approximate sinusoidal translational movement can be obtained from seven or ten air cells.

Figure 17A:
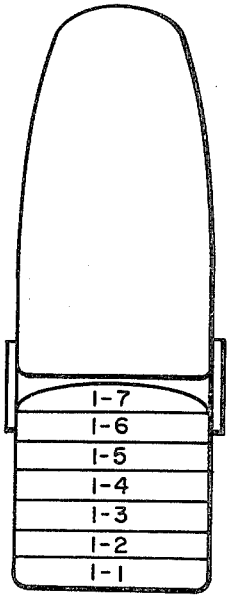
FIG. 17*a* is a plan view of the seat of FIG. 2 utilizing a single 7-cell unit with one control mechanism.
Figure 17B:
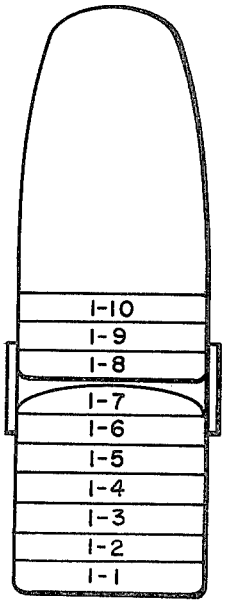
FIG. 17*b* is a plan view of a modified seat utilizing a single 10-cell unit and one control mechanism.
Figure 17C:
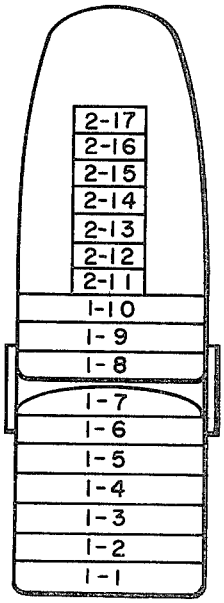
FIG. 17*c* is a plan view of another modified seat utilizing one 10-cell unit and one 7-cell unit, each with a separate control mechanism, and, FIG. 17*d* is another modification of a seat utilizing two 10-cell units with separate control mechanisms.
Figure 17D:
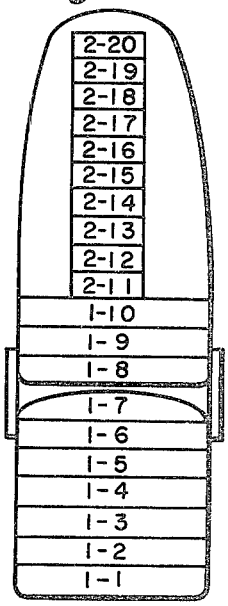

Various seat configurations using one or both of the seven and ten cell units are illustrated in FIGS. 17*a*–17*d*. In FIG. 17*a*, a seven cell unit (cells 1-1 to 1-7) is used in the bottom of the seat while in FIG. 17*b*, a ten cell unit has seven cells (1-1 to 1-7) on the bottom and three cells (1-8 to 1-10) at the lower back. In FIG. 17*c*, a ten cell unit has the cells located as in FIG. 17*b* and a separate seven cell unit has been added to the back to provide cells 2-11 to 2-17. FIG. 17*d* provides a seat with two 10 cell units, the first providing cells 1-1 to 1-10 on the bottom and back of seat, and the second providing the smaller cell 2-11 to 2-20 on the seat back. Separate valves and motors are used when two separate units are combined in the same seat. It is understood that the individual units of FIGS. 17*a*–17*d* can be constructed as described in connection with units 18 and 18'.

Various other modifications of inflatable units are contemplated in different seat arrangements. Also, various valves can be used to control the cell inflation. However, a novel control mechanism is provided having a valve in which the rotor is continuously driven and receives air pressure at a location to hold the rotor against the face of the stator so that air leakage is held to a minimum. Also the same rotor is utilized to exhaust the cells through a much enlarged exhaust passage in the stator. The small size of the control mechanizm permits it to be securely mounted inside the seat unit by cement or other attachment without interfering with seat comfort.

What is claimed is:

1. In an inflatable seat unit having a plurality of adjacent, individual elongated air cells located on a seat and selectively inflated by a control mechanism to produce a translational pressure wave along the seat;

said unit comprising a piece of foam material containing a cavity;

said air cells being completely located in said cavity;

a portion of said material fully overlying all said air cells and located at a surface of said seat;

said portion of said material overlying said air cells having a thickness permitting said wave to be transmitted therethrough to a seat occupant while providing a soft surface when said cells are not inflated.

2. In an inflatable seat unit as defined in claim 1;

said control mechanism being connected with a pressurized air line and an exhaust air line and being completely contained within said foam layer and rigidly secured thereto;

3. In an inflatable seat unit as defined in claim 2;

each of said individual air cells being connected to said control mechanism by a separate air tube;

all of said air tubes being completely contained within said cavity.

4. In an inflatable seat unit as defined in claim 3;

said control mechanism comprising a motor, a valve rotated by said motor and a stator containing separate air passages connected with each of said air tubes;

a housing for said rotor having an opening connected with said pressurized air line;

said valve receiving said pressurized air on one side thereof and having an opening therethrough large enough to overlie several of said air passages;

an exhaust space on the other side of said valve overlying air passages not opposite said valve opening;

an exhaust passage through said stator for connecting said exhaust space to said exhaust air line;

rotation of said valve opening introducing pressurized air to said air cells successively to produce said wave motion in said overlying unit portion, said pressurized air forcing said valve against said stator.

5. In an inflatable seat unit as defined in claim 1;

said piece of foam material being constructed of two layers of said foam material each having an outer planar surface.

6. In an inflatable seat unit as defined in claim 1;

said piece of foam material being constructed of a single layer of said foam material, one surface of said layer being planar and the other surface containing said cavity.

7. In an inflatable seat unit as defined in claim 6;

said backing board being entirely contained within said cavity.

8. In an inflatable seat unit as defined in claim 1;

a backing board located at the side of said air cells opposite said material portion.

said air cells being held in position by said backing board.

9. In an inflatable seat unit as defined in claim 1;

a backing board located at the side of said air cells opposite said material portion and containing two openings opposite the ischial tuberosities of the occupant.

* * * * *